US007644644B2

(12) United States Patent
Shikanai et al.

(10) Patent No.: US 7,644,644 B2
(45) Date of Patent: Jan. 12, 2010

(54) CAP OPENING APPARATUS

(75) Inventors: Atsushi Shikanai, Chiba (JP); Kazuhiro Sasaki, Chiba (JP)

(73) Assignee: Yamada Electric Ind. Co. Ltd., Chiba (JP)

( * ) Notice: Subject to any disclaimer, the term of this patent is extended or adjusted under 35 U.S.C. 154(b) by 0 days.

(21) Appl. No.: 11/659,801

(22) PCT Filed: Aug. 8, 2005

(86) PCT No.: PCT/JP2005/014513

§ 371 (c)(1),
(2), (4) Date: Feb. 9, 2007

(87) PCT Pub. No.: WO2006/016552

PCT Pub. Date: Feb. 16, 2006

(65) Prior Publication Data

US 2008/0078270 A1 Apr. 3, 2008

(30) Foreign Application Priority Data

Aug. 10, 2004 (JP) ..... 2004-232867

(51) Int. Cl.
*B67B 7/00* (2006.01)

(52) U.S. Cl. ..... 81/3.2; 7/152

(58) Field of Classification Search ..... 81/3.09, 81/3.2, 3.33; 7/151, 152, 156
See application file for complete search history.

(56) References Cited

U.S. PATENT DOCUMENTS 1,894,556 A 1/1933 Edlund
3,950,801 A * 4/1976 Morrison ..... 7/152
4,334,332 A * 6/1982 Downs ..... 7/150

FOREIGN PATENT DOCUMENTS

JP 52-103281 8/1977
JP 3103926 6/2004

* cited by examiner

*Primary Examiner*—D. S Meislin
(74) *Attorney, Agent, or Firm*—McGinn IP Law Group, PLLC

(57) ABSTRACT

To solve problems in a conventional cap opening apparatus wherein it is uneconomical and requires a large storage space to prepare dedicated cap opening apparatus to open the caps of various cans and bottles sealed by different systems and, in a conventional cap opening apparatus having cap opening functions for different applications at both ends of a single output shaft, when one of the functions is set to develop a proper capacity, the other develops an excessive or a sufficient capacity.

This cap opening apparatus comprises a speed changing portion 50 having a gear train for matching the output of a motor to the purposes of a plurality of output shafts and an output power changing section for the gear train. Since the speed changing portion transmits optimum torques to the output shafts 133 and 140 and can selectively drive only one output shaft through the output power changing section, safety can be increased. Further, an installation space and a storage space can be saved by adopting a ceiling-hanged type apparatus.

5 Claims, 13 Drawing Sheets

300

CAP OPENING APPARATUS

TECHNICAL FIELD

The present invention relates to a cap opening apparatus for opening a cap of articles such as cans, jaws, and the like of which the cap is to be opened, in particular, to the cap opening apparatus having a jaw rolling opener function that roll and open the cap of the articles such as cans, jaws, and the like of screw lid methods with the cap matched in a screw ditch and closed (namely, a screw off removable lid or cap), and a can opener function that open the cap of cans by cutting the cap for screwing and enclosing the cans.

BACKGROUND ART

It is assumed that a cap of cans and jaws of screw lid methods with the cap matched in a screw ditch to be opened or closed, which are often used as containers of various goods such as food, drinks, cosmetics, or the like, is opened by human power. Accordingly, it is common that the cap is opened in the manner that a container portion held by one hand and a cap portion squeezed by the other hand are twisted in the direction opposite to each other. Those most parts of goods are manufactured in factory while caps of the cans and jaws are closed by machine. It is therefore common that the cap is opened with a seal being simultaneously broken at the time of starting of use of the can or jaw. Otherwise, assuming that the cap is closed with no seal, it is commonly difficult that the cap is opened, on the ground that the cap has been tightly closed at the beginning. Further, the cap portion is relatively thin and made small, compared with the container portion, so that the cap portion has a narrow area to be held by human hand. Therefore, everyone cannot utilize his weak grasping power sufficiently. As a result, it still more becomes difficult that the cap is opened by human hand. Under these circumstances, as shown in, for example, the patent reference 1, many proposals have been made about assisting tools at the time of handling operation of opening the cap. However, in a particular case that the cap has been tightly closed, from human engineering point of view, the can or the jaw is apt to be held and twisted in its inclined condition, when further power is to be applied. It therefore becomes difficult that the container portion is held in the vertical direction. Consequently, particularly in a case that contents of the can or the jaw are goods of liquid or powder, there is a problem that the contents are spilt due to vigor at the time of opening the cap thereof.

Patent reference 1: U.S. Pat. No. 1,894,556

On the other hand, apart from a case that the contents of the can or the jaw are completely consumed at once, it is common that remaining contents are saved with the cap thereof is closed. The cap has sometimes been closed with a little too tight. The contents of the can or the jaw are sometimes adhered to the cap, because the cap has been closed in a condition that the contents were added to the cap. In these cases, there is a problem that the cap was hardly opened.

Further, even if the cap has not been closed so tightly, a similar problem is caused to occur. Namely, it is difficult for a person of weakness having a comparatively weak grasping power such as a housewife, an infant, an old man to open the cap.

In order to solve such a problem, there are proposed many ideas that even a person of weak power can open the cap of a can or a jaw even by his one hand by mechanically opening the cap with a use of motive power of a motor, and the like in a condition that the container thereof is maintained in the vertical direction. Under these circumstances, the inventors of the present application have made, in the patent reference 2, an invention of an automatic cap opening apparatus suitable for opening caps of cans or jaws of screw lid methods with the caps matched in a screw ditch and closed.

Patent reference 2: Japanese Utility Model No. 3103926

In addition, there are some containers incapable of being opened only by hands and fingers, like canned foods wound up and closed, bottle beers closed by a capsule (crown cap), and the like. In cases of these containers, contained are goods of which caps are to be opened by the use of instruments for exclusive use, such as a can opener, a corkscrew, and so on. On the other hand, it has recently been generalized that a can of pull-top method capable of being opened by hands without a can opener is used in canned foods for articles of foods and drinks. However, there are still many canned foods of the type in which caps of the canned foods are cut off and thereby opened. If this type of the can is opened, it becomes necessary to use the instruments for exclusive use in the operation. Accordingly, a person having a weak power cannot sometimes open the cap of the type of the can. There is also a problem that a person opening the can is sometimes injured by slip of the instrument. Under such circumstances, products such as an electric-motive can opener, or the like have been supplied in the market from the considerable past. For example, as an invention filed in the United States on Nov. 27, 1959 and thereafter filed in Japan next year claiming Priority, a proposal is made about an improved can opener with an attached motor that is disclosed in the patent reference 3. In the improved can opener, driving gear revolving by motor is pushed and touched to a circumference of turning edge of a cap of the can from the inner side thereof while round cutting wheel is pushed and touched to the circumference of turning edge from the outer side thereof. The circumference of turning edge of the cap of the can is being thereby snipped strongly, and under such a condition, the outer side of the cap of the can has been cut completely. Consequently, the cap of the can is opened by the improved can opener.

Patent reference 3: Japanese Laid-open Official Gazette Sho37-15683

The Patent references 2 and 3 disclose apparatus each aiming at opening a cap of a can similarly to each other, however, one opens the cap of the can by revolving along a screw ditch while the other opens the cap by cutting the cap of the can. Thus, these apparatus are cap openers of methods completely different from each other. It is therefore necessary to prepare both the apparatus in order to meet with all jaws and cans. This causes troublesome to change the apparatus responsive to the object of cans or jaws. In addition, it also becomes necessary to prepare more space for containing the both apparatus. That also causes problems of many vain, such as much cost, or the like. In order to solve those problems, for example, in an invention disclosed in the patent reference 4, a proposal is made about an apparatus having both functions with a revolving stage and a can sending gear driven by one motor being provided.

Patent reference 4: Japanese Laid-open Official Gazette Sho52-103281

Namely, according to Patent reference 4, a housing, that is a main housing, is configured by, what we call, sleeping "L" character which is elongated in a horizontal direction rather than in a vertical direction. A flat and box-shaped flame is provided in the inner side of a long and horizontal basic portion of the housing with a driving motor being fixed on upper surface of the end of the flame and a shaft of the driving motor being inserted through the inside of the flame. A pinion gear is provided in a head of the shaft of the driving motor. By reducing rotation speed of the driving motor in line with gear series consisting of a plurality of stages constituted within the box-shaped flame, a rotation torque of the driving motor is increased. Thereby, motive power transferring means are constituted in order to transfer the motive power to the output power shaft of the last stage. A rotation stand (rotational table) for rotating can or jaw mounted thereon consisting of circular plate with friction pad of circular rib being attached to surface thereof is fixed to an upper end portion of the output power shaft of the last stage penetrating through the box-shaped flame and the housing. On the other hand, a can sending gear of a can opener is provided to a lower end portion of the output power shaft of the last stage penetrating through the box-shaped flame down to the reverse side of the box-shaped flame.

An upper portion of the driving motor is contained in an inner side of a vertical portion consisting of the vertical section of the housing. Further, in an upper end of the vertical portion, a chock supporting pole, which is supported rotationally over 90 angles by pushing a plunger of coil loaded type and releasing stick thereof, is vertically provided around a pin for a pivot supporting body. In the chock supporting pole, a chock having clamping means that is capable of slid moving and is for fixing at an optional position is projection-provided in line with a gear rack provided in a longitudinal direction. Under this condition, let a can or a jaw be sandwiched between a lower surface of the chock and the rotation stand facing in parallel to the lower surface of the chock, so that the chock and the rotation stand are friction fitted. Let the rotation stand be driven by a motor, so that a cap of the can or the jaw is opened by being rotated. A function disclosed in the Patent reference 4 is thus operable.

On the other hand, another function disclosed in the Patent reference 4 is a can opener function. This is such a function operable as follows. Namely, let the housing rotate over 90 angles around the pin for the pivot supporting body by pushing the plunger of coil loaded type and let the long and horizontal base portion be vertical. Thereby, a portion which has ever been a bottom surface appears as a vertical surface. At the same time, the output power shaft which has ever been a vertical position is rendered to be a horizontal condition. Similarly, the rotation stand which has ever been facing in parallel to the lower surface of the chock is rendered to stand up vertically so that the rotation stand may be in parallel to the chock supporting pole. Further, the can sending gear which has ever been facing a floor surface appears as a vertical surface. While the can sending gear strongly sandwiches the screwing and enclosing end of a can between a rotation cutting blade and the can sending gear and rotate the screwing and enclosing end, the can sending gear cut and open an inner side of the screwing and enclosing end so as to open the cap.

BRIEF SUMMARY OF THE INVENTION

Problems To Be Solved By The Invention

According to the Patent reference 4, it is realized that two apparatus having respective functions different from each other are combined. However, there are remaining problems which have not yet been solved. For example, in a structure disclosed in the Patent reference 4, both the rotation stand for rotating a can or a jaw mounted thereon and the can sending gear for strongly sandwiching and rotating the screwing and enclosing end of the can or the jaw are fixed to both ends of one output power shaft. Therefore, a torque rotating the can or the jaw and a torque rotating the can sending gear are completely equal to each other. Consequently, this causes a certain problem. Namely, if one is adjusted to be an adequate value, the other comes to have too much or too little value.

In addition, the rotation stand is positioned between the chock supporting pole and the housing, when the apparatus disclosed in the Patent reference 4 is used as a can opener. Further, even though the rotation stand seldom comes to contact with a hand of a user, the rotation stand continues to rotate. Accordingly, a problem still remains in safety. Further, in a case that the apparatus is used as a can opener, another problem is also caused to occur. Namely, since a position of the output power shaft is fixed, a height of a can subjected to the apparatus is limited by itself. Nevertheless, if a height from the floor surface up to the position of the output power shaft is made larger, some fundamental problems are inevitably caused to occur. Namely, if the height is made larger, the position of the rotation stand would be changed. A center of the rotation is thereby more and more separated from the chock supporting pole. As a result, an arm of the chock constituted by single durability support becomes long, when the apparatus is used as a cap opener. Therefore, bending moment becomes more and more large. Further, a gap between a central axis of the can or the jaw and an axis of rotation torque also becomes large. Accordingly, cap opening power is largely reduced in the apparatus.

The present invention has been made in view of the above problems. It is an object of the present invention to provide a cap opening apparatus capable of opening, by a single power source, caps of various types of articles to be opened, such as cans, jaws, or the like of which the caps are closed by different methods, by operations methods or rotations torques suitable for respective types.

Means for Solving Problems

In order to achieve the above object, a cap opening apparatus according to an embodiment of the present invention comprising:

a single power source for generating power;

a first last end output power shaft which is capable of rotating by receiving transfer of the power;

a second last end output power shaft which is capable of rotating by receiving transfer of the power;

a first transfer section for transferring the power generated by the single power source to the first last end output power shaft;

a second transfer section for transferring the power generated by the single power source to the second last end output power shaft at a gear ratio different from that of the first transfer section;

a cap rotating and opening section which squeezes a cap of a first article to be opened and opens the cap by rotating the cap by the use of rotation driven by the first last end output power shaft; the first article to be opened being closed by a cap which is fitted to the first article with a screw ditch; and a can opener and cap opening section which cuts can wall of a second article to be opened and opens the cap by the use of rotation driven by the second last end output power shaft.

With the structure, the power generated by the single power source can be transferred to the first last end output power shaft and the second last end output power shaft, respectively, as adequate number and torque of rotations.

In addition, the cap opening apparatus may further comprise an output power changing section which transfers the power generated by the single power source to either the first transfer section or the second transfer section. With the structure, while a function utilizing one of the first last end output power shaft or the second last end output power shaft is being used, it is possible to perfectly prevent the other of the first last end output power shaft or the second last end output power shaft being operable. Thereby, safety of the cap opening apparatus can be improved.

Further, the cap opening apparatus may further comprise a power source side gear which receives power from the single power source; the first transfer section further comprising a first side gear for transferring power to the first last end output power shaft while the second transfer section further comprising a second side gear for transferring power to the second last end output power shaft; and the output power changing section further comprising a changing gear capable of changing a first output power condition and a second output power condition, the changing gear matching with the power source side gear, the first side gear, respectively in the first output power condition while the changing gear matching with the power source side gear and the second side gear in the second output power condition. Furthermore, the first transfer section may have the slowdown ratio larger than that of the second transfer section.

In addition, in the cap opening apparatus, the cap rotating and opening section may further comprise a cap handling portion which supplies power for narrowing a gap between squeezing nails for squeezing the cap of the first article to be opened by rotation in one direction of the first last end output power shaft, and a spring which stores repulsion for rotation in the other direction at the time of the rotation in one direction; the first last end output power shaft being rotated in the other direction by the repulsion of the spring to release handling of the cap of the first article to be opened by the cap handling portion, when a transfer of power from the single power source to the first last end output power shaft has been finished.

Further, in the cap opening apparatus, the cap rotating and opening section may further comprise a lower handling portion which handles a lower portion of the first article to be opened; a lower housing in which the lower handling portion is provided; and an upper housing in which the cap handling portion is provided, a supporting pole being provided in one of the upper housing or the lower housing while a guide member being provided in the other of the upper housing or the lower housing, a guide hole for guiding the supporting pole being formed in the guide member, the supporting pole being inserted through the guide hole and thereby the upper housing and the lower housing being capable of sliding up and down to each other.

Moreover, the cap opening apparatus may further comprise a stick member; a supporting portion which supports the stick member in the upper housing with the stick member capable of rotating on a predetermined plain surface; and a handling portion which handles the stick member in the lower housing with the stick member capable of rotating on a plain surface and moving in a horizontal direction on the plain surface.

With the structure, it is possible to readily adjust a gap between the lower housing and the upper housing by rotating the stick member around the supporting portion.

In addition, the cap opening apparatus may further comprise a corkscrew portion on a surface of a body of the cap opening apparatus, the corkscrew portion being for opening a capsule (crown cap) of bottle beers, or the like.

DETAILED DESCRIPTION OF THE EXEMPLARY EMBODIMENTS OF THE INVENTION

Figure 1:
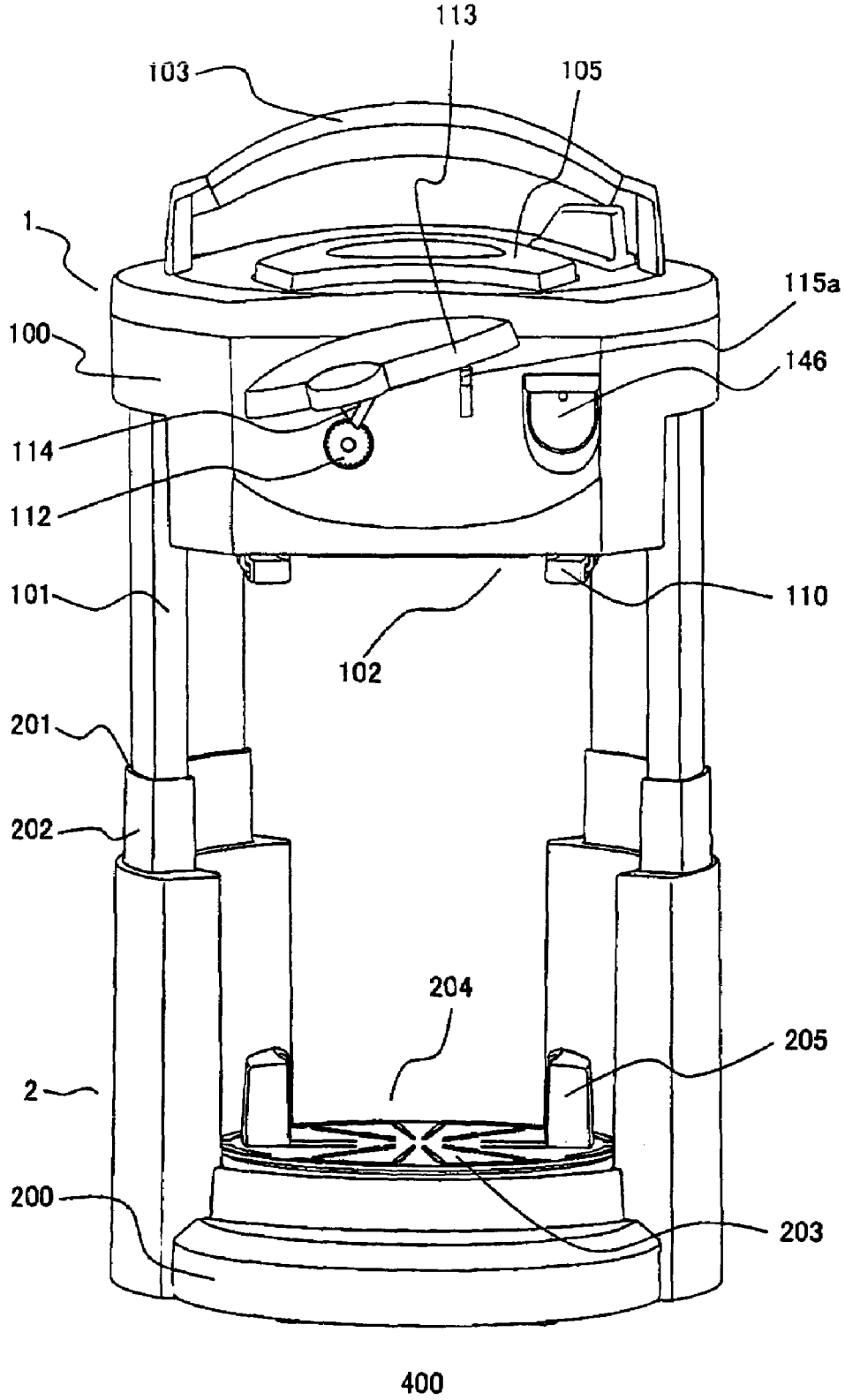
FIG. 1 is a perspective view of an external appearance of a cap opening apparatus according to a first embodiment of the present invention, in which the cap opening apparatus is seen from the front thereof.

According to the present invention, it is possible to adequately transfer, by a single power source, number and torque of rotations suitable for a plurality of cap opening functions, respectively, to respective output power shafts utilized in the plurality of cap opening functions.

Best Mode for Carrying Out the Invention

Referring to the drawings, description is made about embodiments of the present invention. Besides, the claimed inventions of this application are never limited by the embodiments described as follows. Further, not all combinations of features of the invention described in the embodiments are essential for the means for solving problems.

Embodiment 1

Hereunder, referring to FIG. 1 through FIG. 7 and FIG. 9, description will be made about a cap opening apparatus according to a first embodiment of the present invention.

Figure 2:
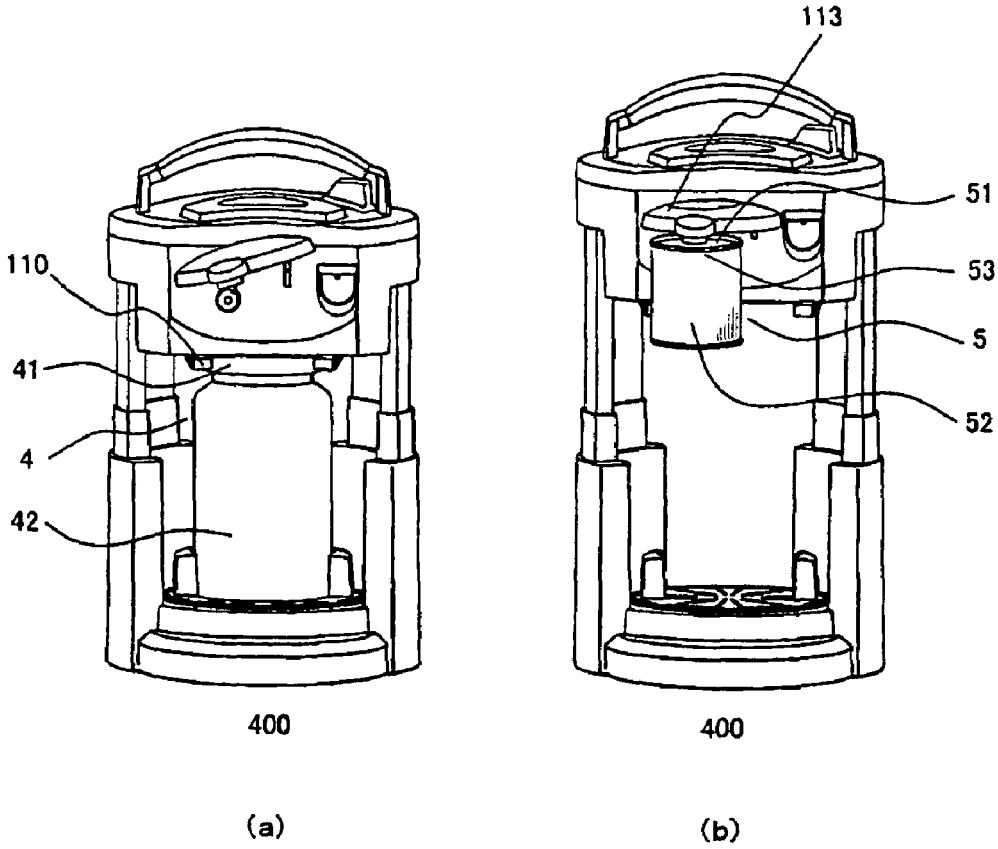
FIG. 2 is a perspective view of an external appearance of the cap opening apparatus according to the first embodiment of the present invention, in which conditions of use of the cap opening apparatus different from each other are shown.

FIG. 1 is a perspective view of an external appearance of a cap opening apparatus according to a first embodiment of the present invention, in which the cap opening apparatus is seen from the front thereof. FIG. 2 is a perspective view of an external appearance of the cap opening apparatus according to the first embodiment of the present invention, in which conditions of use of the cap opening apparatus different from each other are shown.

First, referring to FIG. 1 and FIG. 2(*a*), description is made mainly about a constitution relating to condition of use of a cap opening function of a cap opening apparatus 400, shown in FIG. 2(*a*), which opens a cap of article to be opened (first article to be opened), such as a can, a jaw, and the like, of screw lid methods with the cap matched in a screw path to be opened or closed.

The cap opening apparatus 400 comprises an upper housing 1 which constitutes a partial aggregate and a lower housing 2 which constitutes a partial aggregate. A hollow supporting pole 101 having a sector shape in its cross section is projected and provided on a plurality of positions of outer circumferential of a lower surface of an upper case 100 of the upper housing 1. A peripheral portion 202 consisting of a guide member is cylindrically provided in its standing condition on an upper surface of a lower case 200 of the lower housing 2. In the peripheral portion 202, a guide hole 201 having a sector shape in its cross section is formed so that the guide hole 201 may be facing to the hollow supporting pole 101. The hollow supporting pole 101 is inserted through the guide hole 201 with a minute gap being kept between the hollow supporting pole 101 and the guide hole 201. With the structure, the upper housing 1 is constituted to be capable of sliding up and down on the lower housing 2. Further, a central axis of a lower handling portion 204, as will be later described, for sandwiching a lower portion of a screw lid container 4 on the lower housing 2 can be substantially corresponding to a rotation axis of an upper handling portion 102, as an example of a cap handling portion formed on the upper housing 1 for sandwiching a cap 41 of the screw lid container 4. Consequently, cap opening power can be improved, when the cap 41 of the screw lid container 4 is opened.

The cross sections of not only the hollow supporting pole 101 projected and provided on the upper case 100 but also the guide hole 201 formed on the upper surface of the lower case 200 are formed to have sector shapes, respectively. The reason is that an effective area for mounting a can or a jaw can be obtained more largely, assuming that outer diameters of cap opening apparatus 400 are identical with each other.

Figure 9:
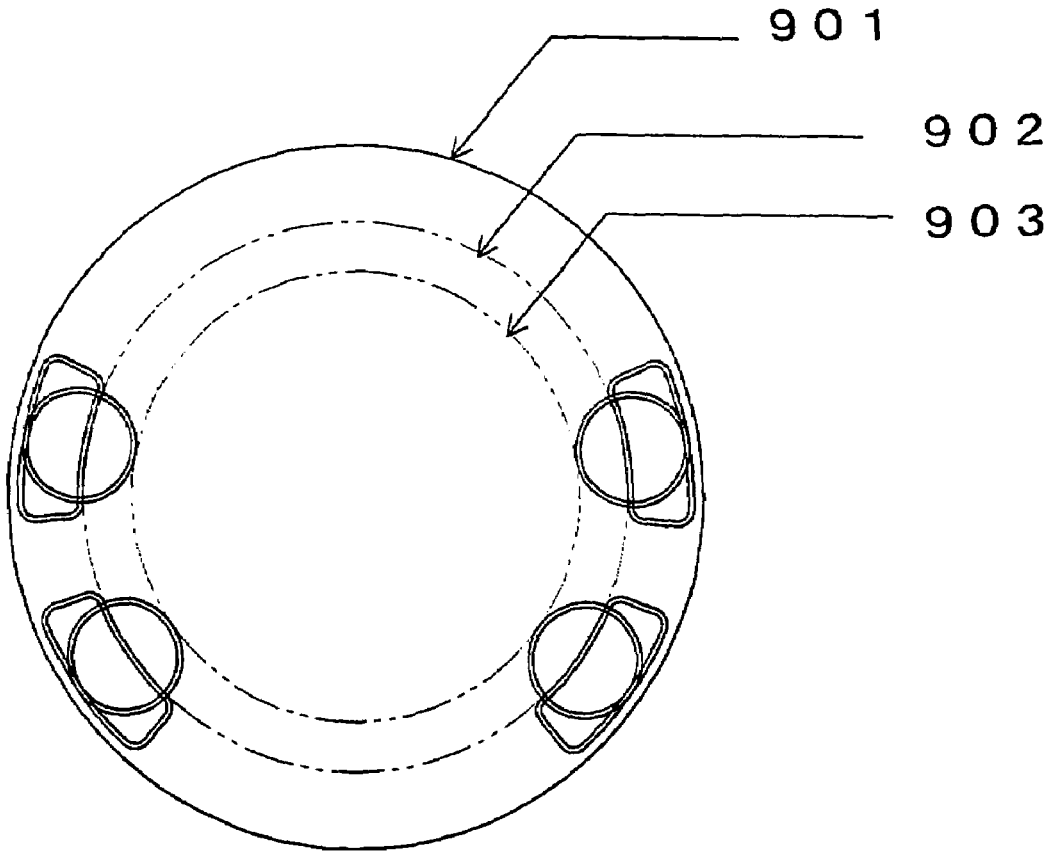
FIG. 9 is an explanation view for showing merits of a configuration of a supporting pole of the cap opening apparatus according to the first embodiment of the present invention.

FIG. 9 is an explanation view for showing merits of a configuration of a supporting pole of the cap opening apparatus 400.

As illustrated in FIG. 9, in a case that an area of a cross section of the hollow supporting pole 101 is the same as that of the guide hole 201 for obtaining the same strength as each other, the effective area for mounting the can or the jaw can be obtained more largely not by forming cross sections of circular shapes but by forming those of sector shapes, respectively. Accordingly, the cap opening apparatus 400 can be applied to a cap opening of a can or a jaw having a larger diameter. In FIG. 9, 901 denotes an area in accord with the outer diameter of cap opening apparatus 400, 902 denotes an effective area in a case that the supporting pole 101 has a sector shape cross section, and 903 denotes an effective area in a case that the supporting pole 101 has a circular shape cross section.

Herein, a gap between the hollow supporting pole 101 and the guide hole 201 should be desirably larger, in order that the upper housing 1 may be smoothly sliding up and down on the lower housing 2. However, if the gap is kept too large, inclination of the upper housing 1 with respect to the lower housing 2 becomes large. The central axis of the lower handling portion 204 thereby becomes offset from the rotation axis of the upper handling portion 102, when the can or the jaw is handled. Accordingly, in this embodiment, the peripheral portion 202 of the guide hole 201 is cylindrically provided in its standing condition as illustrated in FIG. 1, a sliding surface is made comparatively large in length. Thereby, the inclination generated as mentioned above can be reduced, while the gap is kept enough. In order to increase stability, it is favorable that numbers of the supporting pole 101 are not fewer than three. The numbers of the supporting pole 101 are four in this embodiment. Besides, the numbers of the supporting pole 101 may be one or two, dependent on a shape of the supporting pole 101.

Figure 3:
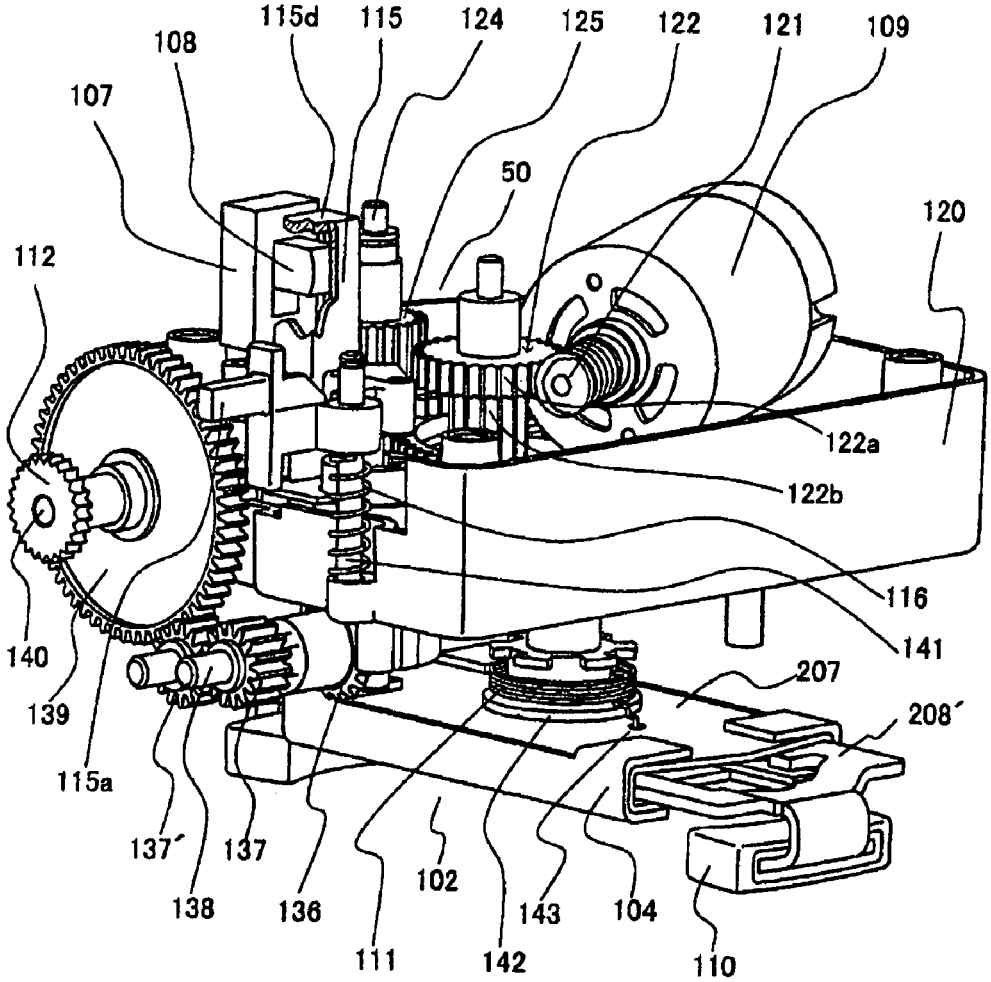
FIG. 3 is a perspective view of the cap opening apparatus according to the first embodiment of the present invention, in which a part of a speed changing portion is included.
Figure 4:
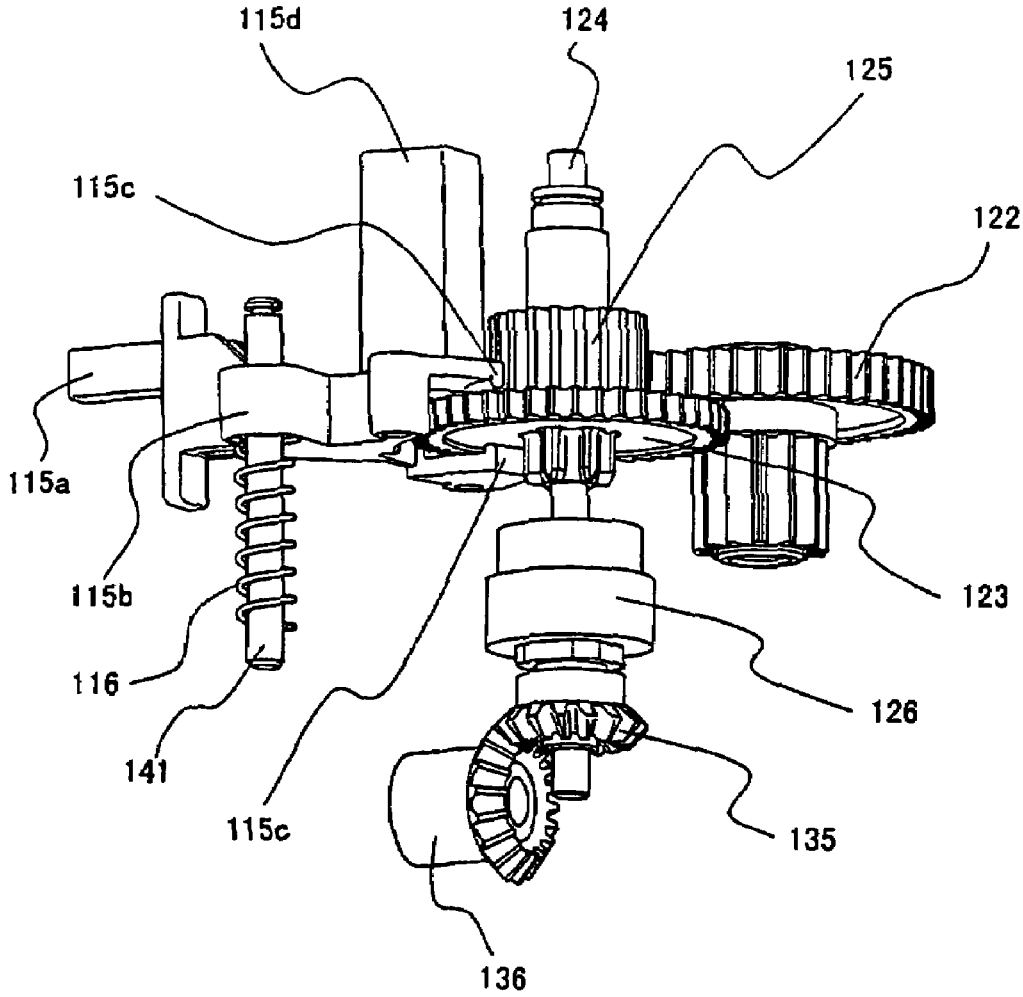
FIG. 4 is a perspective view of the cap opening apparatus according to the first embodiment of the present invention, in which a part of an output power changing section is included.
Figure 10:
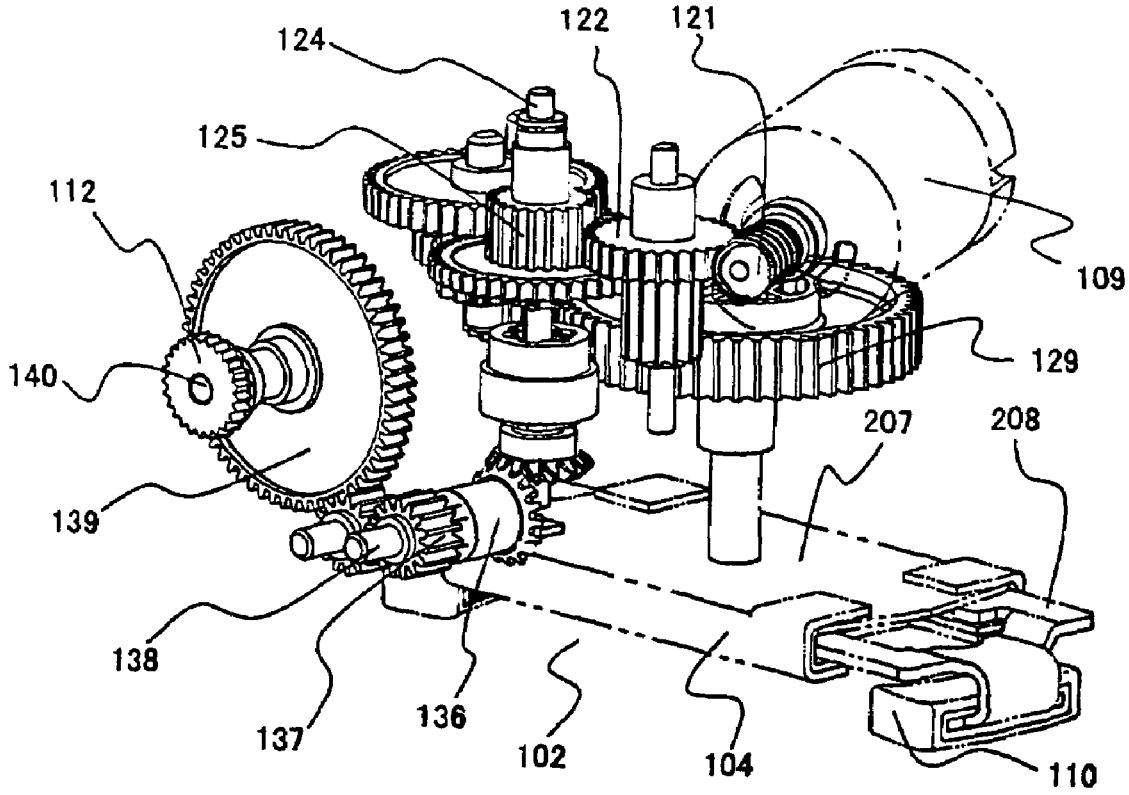
FIG. 10 is a perspective view of the cap opening apparatus according to the first embodiment of the present invention showing the gears and shafts.
Figure 11:
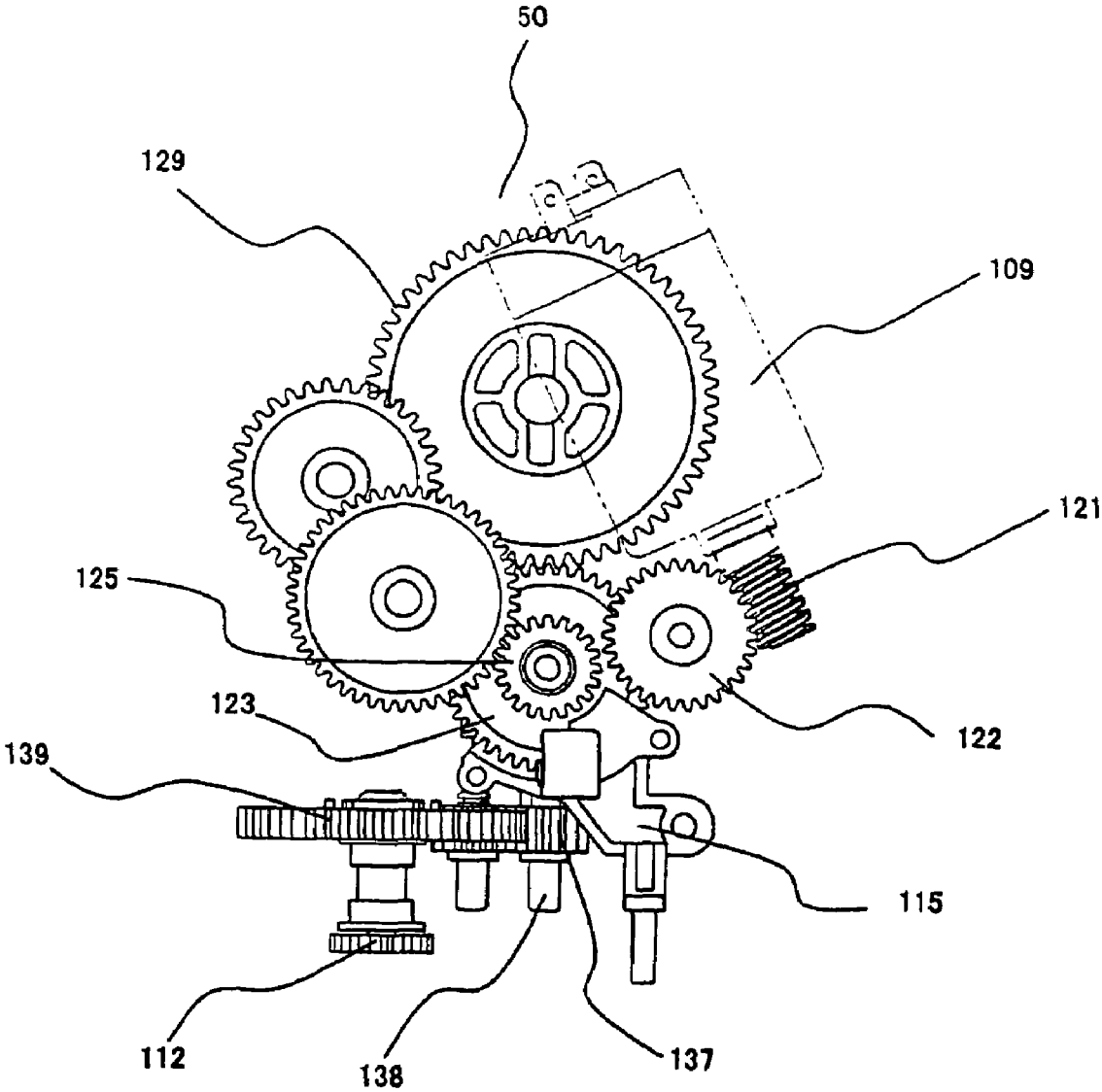
FIG. 11 is a plan view of the cap opening apparatus according to the first embodiment of the present invention showing the shifting section.
Figure 12:
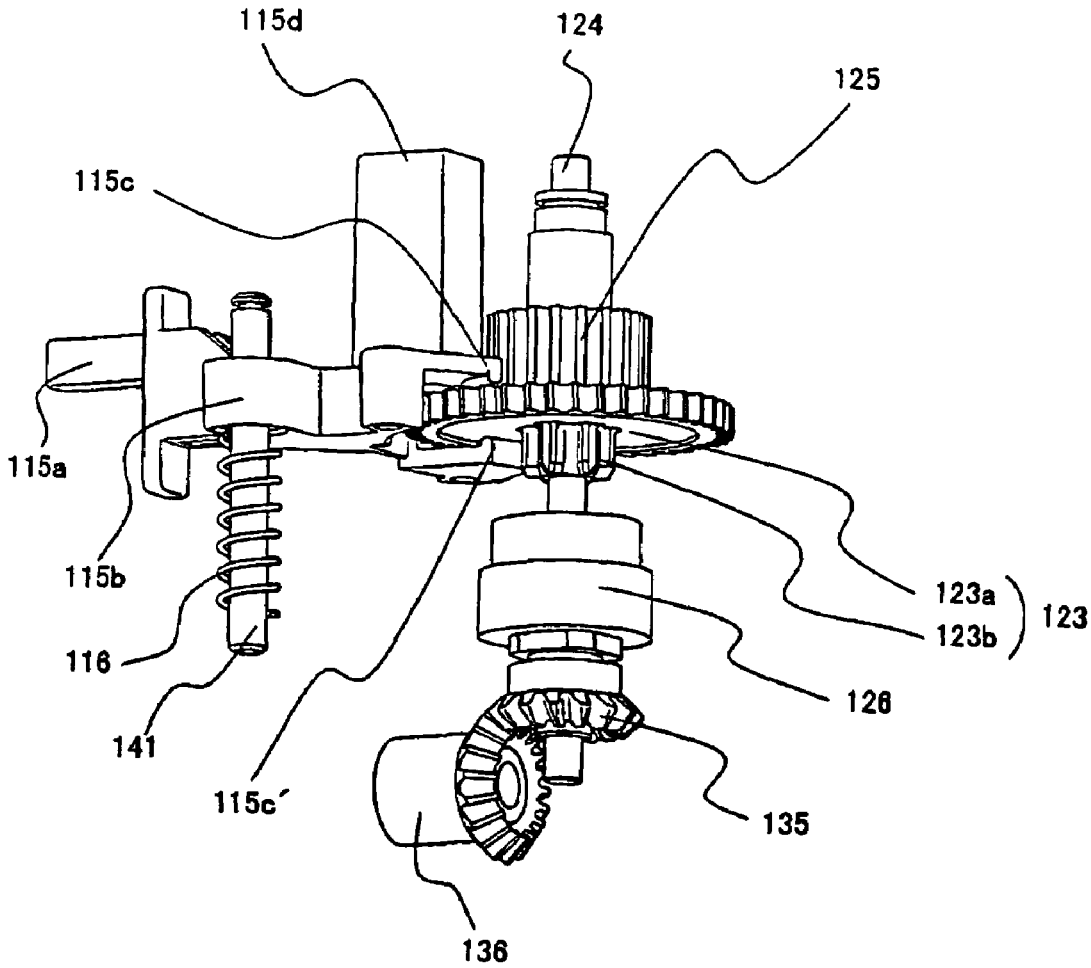
FIG. 12 is another perspective view of the cap opening apparatus according to the first embodiment of the present invention.
Figure 13:
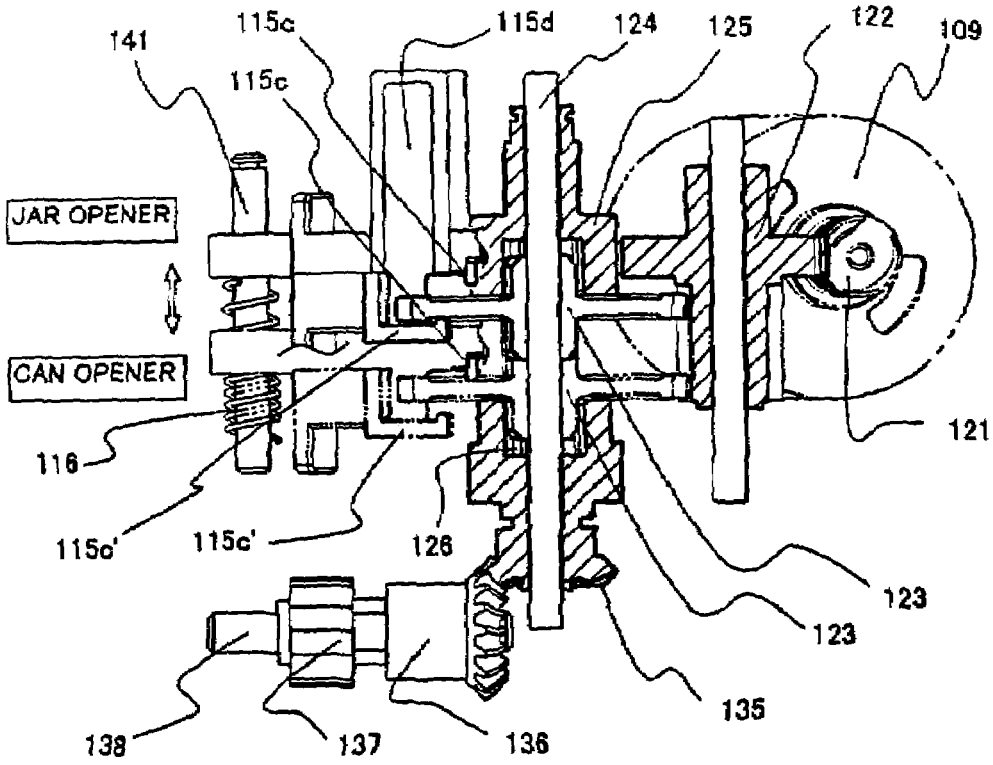
FIG. 13 is a perspective view of the cap opening apparatus according to the first embodiment of the present invention showing change between can opening and jar opening.

FIG. 10 is a perspective view similar to FIG. 3, in which the gear box 120 and some members (parts) other than gears and shafts are removed. FIG. 11 is a plan view of the shifting section (speed changing section) 50 within FIG. 3 showing a sectional view in a horizontal direction of FIG. 3. FIG. 12 is a perspective view similar to FIG. 4, in which the member 122 of FIG. 4 is omitted. FIG. 13 is a view for showing change between can opening (opener) and jar opening (opener) showing a vertical sectional view cut by in line with centers of the gear 122 and gear 125 of FIG. 3.

Next, description proceed to steps of user's operation for using the cap opening apparatus 400 and actions of the cap opening apparatus 400 in a case of opening a cap of the screw lid container 4. First, the user lifts up the upper housing 1 by handling a handle 103. Thereby, a space for inserting the screw lid container 4 to be opened can be obtained between the upper housing 1 and the lower housing 2 as a first cap opening section. Next, the user mounts the screw lid container 4 to be opened on a rotation stand (rotational table) 203 and rotates the outer peripheral portion of the rotation stand 203 by his hand in a counter-clockwise direction. Consequently, as will later be described in detail, while a pair of squeezing nails 205 of the lower handling portion 204 push a container portion 42 of the screw lid container 4 from both sides of the container portion 42 equally, the squeezing nails 205 exactly pull the container portion 42 close to the central axis of the rotation stand 203 corresponding to the rotation axis of a rotation torque applied at the time of opening a cap.

The user rotates the rotation stand 203 until the rotation stand 203 comes to a condition incapable of being further rotated by the user's hand. Namely, in such a condition, a pair of the squeezing nails 205 squeeze the container portion 42 of the screw lid container 4 from the both sides thereof, so that the rotation stand 203 comes to a locked condition.

Next, by handling the handle LOS, the user pushes the upper housing 101 down in line with the hollow supporting pole 101 and the guide hole 201, so that a lower surface of a friction pad 104 (See FIG. 7) provided in the upper handling portion 102 may be pushed in contact with an upper surface of the cap 41 of the screw lid container 4. As will later be described more in detail, a surface of the function pad 104 is covered by a material, such as rubber material, and the like which has a large coefficient of friction and is hard to glide.

Thereafter, the user pushes down a switch button (SW button) 105, so that a tongue chip 106 projected and provided integrally or non-integrally on a reverse side surface of the SW button 105 is also pushed down. As a result, a head of the tongue chip 106 pushes down a knob 108 (See FIG. 5) of a switch (SW) 107 (See FIG. 5) of automatic return type. With the knob 108 being pushed down, an electric power supply is spent. A motor 109 (See FIG. 3), as an example of the power source, begins to rotate. Alternatively, without pushing down the SW button 105, the user may further push down the handle 103 so that the friction pad 104 may be pushed strongly in contact with the screw cap 41. Also in this case, the knob 108 of the SW 107 is pushed down by the structure that will later be described in detail. Consequently, the electric power supply is spent, so that the motor 109 begins to rotate.

With the motor 109 beginning to rotate, the upper handling portion 102 rotates in a clockwise direction, when the upper handling portion 102 is seen from the downside thereof. Besides, power is transferred to the upper handling portion 102 by an operation of a speed changing portion 50, as will later be described in detail. Accordingly, a pair of the squeezing nails 110 of the upper handling portion 102 squeeze the screw cap 41 from both sides of the screw lid container 4, so that the squeezing nails 110 pull the screw cap 41 close to the rotation axis of the upper handling portion 102. As a result, the central axis of the screw lid container 4 becomes corresponding to the rotation axis of the upper handling portion 102, so that the screw lid container 4 is firmly fixed.

Herein, if the user separates his hand from the SW button 105 or the handle 103, the knob 108 of the SW 107 automatically returns. The electric power supply to the motor 109 is thereby stopped. Consequently, rotations of the motor 109 are stopped, so that rotations of the upper holding portion 102 are also stopped. On the other hand, if the user continuously pushes the SW button 105 or pushes down the handle 103, the friction pad 104 is continuously pushed in contact with the screw cap 41. In this case, the right and left squeezing nails 110 of the upper handling portion 102 are in a locked condition that the right and left squeezing nails 110 cannot further squeeze the screw cap 41. The upper handling portion 102 which still intends to rotate comes to rotate in a counterclockwise direction seen from the downside thereof, with the screw cap 41 being kept squeezed. As a result, the screw cap 41 which had been closed can be opened.

After thus opening the cap, the motor 109 is continuously rotating, until the user releases the SW button 105 or pushes down the handle 103 to free the power pushing the friction pad 104 in contact with the screw cap 41. Therefore, the upper handling portion 102 is also continuously rotating in a condition that the screw cap 41 is kept squeezed by the right and left squeezing nails 110. Accordingly, if the user releases the SW button 105 or pushes down the handle 103 to free the power pushing the friction pad 104 in contact with the screw cap 41, the electric power supply to the motor 109 is stopped. Consequently, the rotations of the motor 109 are stopped, so that the rotations of the upper handling portion 102 are also stopped.

In this cap opening apparatus 400, a repulsion of a return spring 111 (See FIG. 3) which saved energy by the operations, as will later be described in detail, makes the upper handling portion 102 rotate in a direction (counter-clockwise direction seen from the downside) opposite to the direction at the time of opening a cap in order that a pair of the squeezing nails 110 may move and thereby be separated from each other. Consequently, power squeezing the screw cap 41 is released. It therefore becomes possible that the screw cap 41 is readily removed from the upper handling portion 102. Herein, the cap rotating and opening section is mainly constituted by the upper handling portion 102 and the lower handling portion 204 in this embodiment.

Next, referring to FIG. 1 and FIG. 2(*b*), description is made mainly about a constitution of the cap opening apparatus 400 relating to a condition of use of can opener function illustrated in FIG. 2(*b*). In the constitution, the cap opening apparatus 400 applies a second cap opening section to cut a can wall of an article to be opened (second article to be opened) that the can is enclosed by being wound up, and opens the can.

A canned food 5 which is an example of the second article to be opened is formed by winding a can cap 51 and a can container portion 52 and enclosing the can container portion 52 with the can cap 51. With the structure, a portion thus wound up is a screwing and enclosing end peripheral portion 53 which circles annularly. In a case of using the can opener function of the cap opening apparatus 400, at first, the user needs to push a can opener lever 113 of the second can opening section down in a condition that an outer circumferential lower surface of the screwing and enclosing end peripheral portion 53 of the canned food 5 is mounted on a can sending gear 112. The can opener lever 113 thus being pushed down by the user, a head of a metal cutting blade 114 elastically supported in an intermediate portion of the can opener lever 113 is easily pierced into the inside of a peripheral portion of the can cap 51 by a principle of a lever. Thereby, the canned food 5 is supported by an upper surface of the can sending gear 112 and the inside of a blade surface of the metal cutting blade 114. Accordingly, the canned food 5 comes into a condition that the canned food 5 is set on the cap opening apparatus 400, as illustrated in FIG. 2(*b*).

From the condition, the user further pushes the can opener lever 113 down, so that the metal cutting blade 114 turns the blade surface toward the proceeding direction and stops by limit of elastically supporting power. Consequently, only the can opener lever 113 is to be further pushed down by operations that will later be described in detail. Thereby, a head portion 115*a* of a change lever 115 projected forward from the front of the upper case 100 is rendered to be pushed downward against a repulsion of a return spring 116 (See FIG. 4). With the head portion 115*a* of the change lever 115 being pushed downward, the knob 108 of the SW 107 is pushed down by an SW operation portion 115*d* (See FIG. 3) of the change lever 115 without a pushing of the SW button 105 by the user. Rotations of the motor 109 are thereby started. In this case, the rotations of the motor 109 are not transferred to the upper handling portion 102 by a constitution mentioned later. Accordingly, the upper handling portion 102 remains stopping, and the can sending gear 112 starts rotating in a counterclockwise direction.

The blade surface of the metal cutting blade 114 has been pierced in the direction that the can cap 51 is pressed down. Further, a lower surface of the screwing and enclosing end peripheral portion 53 has been strongly pushed downward, so that the lower surface of the screwing and enclosing end peripheral portion 53 has eaten into a sharp head portion of the can sending gear 112. Thereby, if the can sending gear 112 starts rotating, as mentioned above, the can food 5 is adjusted to be sent by the can sending gear 112. As a result, the can cap 51 is cut and torn by the blade surface of the metal cutting blade 114. Accordingly, when the can cap 51 has rotated round in a clockwise direction in line with the annular screwing and enclosing end peripheral portion 53, opening operation of the can cap 51 is finished.

While the can cap 51 is being cut and torn, the blade surface of the metal cutting blade 114 is bound in a condition that the blade surface of the metal cutting blade 114 is sandwiched and pressed downward by the can cap 51. Therefore, if the user is not continuously pushing the can opener lever 113 by his hand, the metal cutting blade 114 is kept at a position for cutting and tearing the can cap 51. On the other hand, when the opening operation of the can cap 51 has been finished, the blade surface of the metal cutting blade 114 is released from binding. In addition, the repulsion of the return spring 116 is being applied on the change lever 115. Thereby, a power pushing the change lever 115 downward ceases to exist. Consequently, the SW 107 of automatic return type comes to extinguish the electric power supply by return power of itself. The rotations of the motor 109 are thereby stopped. Thereafter, by pulling the can opener lever 113 upward, the user can lift up the metal cutting blade 114 which has been pressing the screwing and enclosing end peripheral portion 53 from the inside. Accordingly, it becomes possible for the user to remove the can food 5 from the cap opening apparatus 400 and utilize the can food 5. Herein, in this embodiment, the can opener and cap opening section is mainly constituted by the can sending gear 112, the can opener lever 113 and the metal cutting blade 114.

Next, referring mainly to FIG. 3 and FIG. 4, detailed description is made about a constitution and operations of a speed changing portion 50 having a first transfer section, a second transfer section, and an output power changing section.

FIG. 3 is a perspective view of the cap opening apparatus according to the first embodiment of the present invention, in which a part of the speed changing portion is included. FIG. 4 is a perspective view of the cap opening apparatus according to the first embodiment of the present invention, in which a part of the output power changing section is included.

The speed changing portion 50 is contained in a gear box 120 which is fixed within the upper case 100 and which is capable of being divided into upper and lower. Hereunder, description will be made about gears or cogwheels as resin casts. However, the gears or the cogwheels are not limited to such resin materials. For example, the gears or the cogwheels may be sintering metals or cutting products.

A worm gear 121 is put on a head of an output power shaft of the motor 109 attached on the gear box 120. The worm gear 121 is engaged with a large gear 122*a* of a first slowdown gear 122 that is an example of a gear of power source side. The first slowdown gear 122 has a small gear 122*b* which is formed integrally with the large gear 122*a*. The small gear 122*b* has a long width in an axis direction thereof and is capable of being engaged with a large gear 123*a* of a speed changing gear 123 in a wide area of the axis direction, as illustrated in FIG. 4.

The speed changing gear 123 as an example of a changing gear has the large gear 123*a* and two small gears 123*b* formed integrally with the large gear 123*a*. Each of small gears 123*b* performs as a power source side gear which receives power from the power source. One of the small gears 123*b* is formed above the large gear 123*a* while another one of the small gears 123*b* is formed under the large gear 123*a* with the large gear 123*a* being sandwiched there between. The small gears 123*b* are largely chamfered, considering that a first intermediate gear 125 of an example of a first side gear is readily united with a second intermediate gear 126 of an example of a second side gear. A through-bore is formed in each center of the large gear 123*a* and the small gears 123*b* of the speed changing gear 123. A rotation axis 124 made, for example, of metal is inserted into the through-bore of each of the large gear 123*a* and the small gears 123*b* so that the large gear 123*a* and the small gears 123*b* may be capable of rotating around the rotation axis 124 and sliding on the rotation axis 124. Namely, the speed changing gear 123 is adjusted to be capable of sliding up and down in line with the rotation axis 124.

Herein, the rotation axis 124 is constituted to be substantially parallel to an axis direction of the first slowdown gear 122. The small gear 122*b* of the first slowdown gear 122 has the long width in the axis direction thereof. Therefore, engagement of the small gear 122*b* of the first slowdown gear 122 with the large gear 123*a* of the speed changing gear 123 is obtained, even though the speed changing gear 123 is sliding up and down.

The first intermediate gear 125 having a through-bore in a center thereof is supported in the upper portion of the rotation axis 124 and capable of revolving around the rotation axis 124. The first intermediate gear 125 has not only an outer tooth but also an inner tooth formed inner side thereof and engaged with the upper side small gear 123*b* of the speed changing gear 123. The first intermediate gear 125 is thereby capable of transferring rotations of the speed changing gear 123.

In this embodiment, the first intermediate gear 125 has the inner tooth while the speed changing gear 123 has the upper side small gear 123*b*. Accordingly, the first intermediate gear 125 is engaged with the speed changing gear 123 by the inner tooth and the upper side small gear 123*b*. However, the present invention is not limited to such a structure. The present invention may have the other structures alternatively, provided that the first intermediate gear 125 can be engaged with the speed changing gear 123. For example, the first intermediate gear 125 may be engaged with the speed changing gear 123 by configurations thereof, such as square, original hexagon, and the like.

A second intermediate gear 126 is supported in the under portion of the rotation axis 124 and capable of revolving around the rotation axis 124. The second intermediate gear 126 has an inner tooth formed inner side thereof and engaged with the under side small gear 123*b* of the speed changing gear 123. In addition, a bevel gear 135 is provided in the second intermediate gear 126.

Besides, in this embodiment, the second intermediate gear 126 has the inner tooth while the speed changing gear 123 has the under side small gear 123*b*. Accordingly, the second intermediate gear 126 is engaged with the speed changing gear 123 by the inner tooth and the under side small gear 123*b*. However, the present invention is not limited to such a structure. The present invention may have the other structures alternatively, provided that the second intermediate gear 126 can be engaged with the speed changing gear 123. For example, the second intermediate gear 126 may be engaged with the speed changing gear 123 by configurations thereof, such as square, original hexagon, and the like.

With the above structure, in a case that the speed changing gear 123 has slid up to the upper portion of the rotation axis 124, the upper side small gear 123*b* of the speed changing gear 123 comes to be engaged with the inner tooth of the first intermediate gear 125. In this embodiment, since the large gear 123*a* of the speed changing gear 123 is engaged with the small gear 122*b* of the first slowdown gear 122 in this condition, the first intermediate gear 125 is adjusted to passively move by rotations of the motor 109. At this time, since the under side small gear 123*b* of the speed changing gear 123 is not engaged with the inner tooth of the second intermediate gear 126, the rotations of the motor 109 are never transferred to the second intermediate gear 126.

On the other hand, in a case that the speed changing gear 123 has slid down to the under portion of the rotation axis 124, the under side small gear 123*b* of the speed changing gear 123 comes to be engaged with the inner tooth of the second intermediate gear 126. In this embodiment, since the large gear 123*a* of the speed changing gear 123 is engaged with the small gear 122*b* of the first slowdown gear 122 in this condition, the second intermediate gear 126 is adjusted to passively move by rotations of the motor 109. At this time, since the upper side small gear 123*b* of the speed changing gear 123 is not engaged with the inner tooth of the first intermediate gear 125, the rotations of the motor 109 are never transferred to the first intermediate gear 125. Thus, either the first intermediate gear 125 or the second intermediate gear 126 is selectively adjusted to passively move, dependent on positions of the speed changing gear 123.

Next, description is made about the constitution of the cap opening apparatus 400 including the first intermediate gear 125 as an example of the first transfer section.

An outer gear of the first intermediate gear 125 is engaged with a large gear of a second slowdown gear (not shown).

Further, a small gear of the second slowdown gear integrally formed with each other is engaged with a large gear of a third slowdown gear (not shown). Furthermore, a small gear of the third slowdown gear integrally formed with each other is engaged with the last stage gear 129.

Next, description is made about constitutions around the last stage gear 129.

Figure 5:
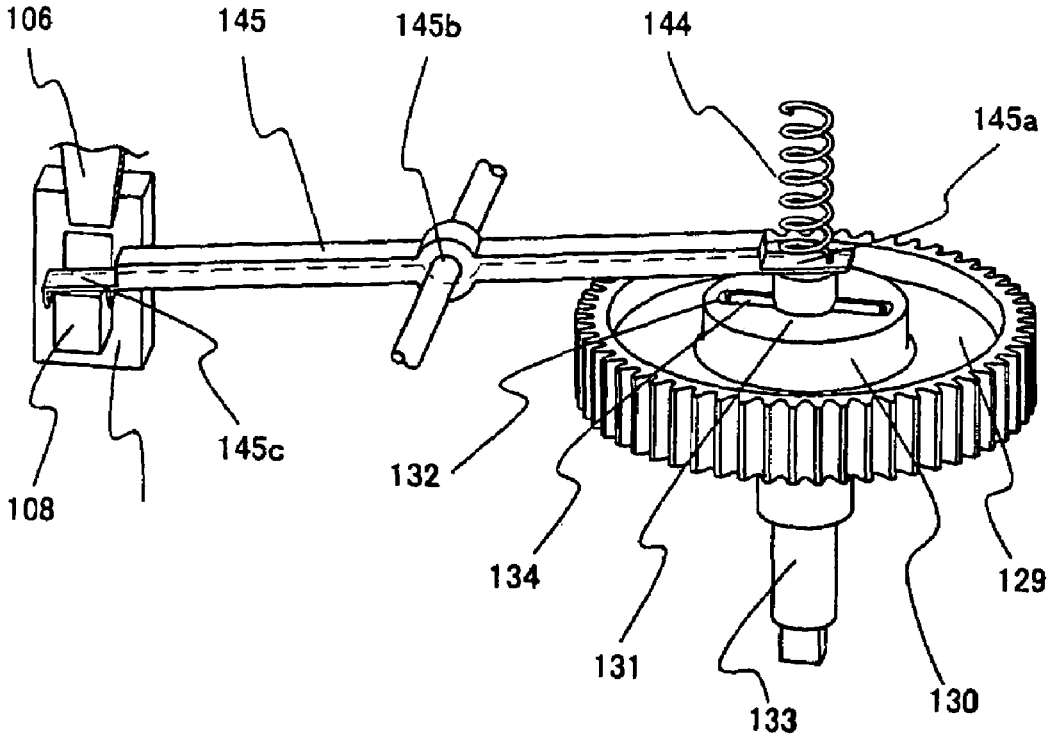
FIG. 5 is a perspective view of the cap opening apparatus according to the first embodiment of the present invention, in which around portions of the last stage gear are explained.

FIG. 5 is a perspective view of the cap opening apparatus according to the first embodiment of the present invention, in which the constitutions around the last stage gear 129 are explained.

A through-bore 131 is bored and provided in a center of a central boss portion 130 of the last stage gear 129. Further, a deep ditch portion 132 for engagement with a knock pin 134 is provided in an upper end portion of the central boss portion 130 of the last stage gear 129. The deep ditch portion 132 has a depth larger than that required for the engagement with the knock pin 134.

A first output power shaft (first last end output power shaft) 133 of metal is inserted through the through-bore 131 of the last stage gear 129. The knock pin 134 is horizontally driven near an upper portion of the first output power shaft 133. The knock pin 134 is constituted so that the knock pin 134 may be engaged with the deep ditch portion 132. With the constitution, rotations of the last stage gear 129 can be transferred to the first output power shaft 133 by way of the knock pin 134.

The upper and lower portions of the last stage gear 129 are supported by the gear box 120 in a condition that the last stage gear 129 is freely capable of rotating. Besides, in this constitution, the first output power shaft 133 is adjusted to be capable of sliding up and down so that the knock pin 134 may be in line with the deep ditch portion 132 of the last stage gear 129. Since the upper handling portion 102 is fixed by screw to the lower end portion of the first output power shaft 133, the cap opening apparatus 400 can realize the function that rolls and opens the cap of a can or a jaw of screw lid method with the cap matched in a screw ditch and closed.

Herein, the reason that the deep ditch portion 132 has the depth larger than that required for the engagement with the knock pin 134 is as follows. Namely, without the user's pushing of the SW button 105, the friction pad 104 may be pushed in contact with the screw cap 41. The knob 108 of the SW 107 is thereby pushed down, so that the electric power supply is spent to the motor 109. Referring to FIG. 5, description is made about a constitution and operations for realizing the above.

The upper end of the first output power shaft 133 is always pushed down by, for example, an elastic member 144, such as spring, or the like. Subsequently, the user pushes the upper handling portion 102 to the screw cap 41, so that the first output power shaft 133 is pushed upward together with the upper handling portion 102. Accordingly, one end portion 145*a* of a close bar 145 linked with the upper end portion of the first output power shaft 133 is then pushed upward, so that another end portion 145*c* of the close bar 145 is rotated downward around a supporting portion 145*b* of the close bar 145. Thereby, the knob 108 of the SW 107 can be pushed down by another end portion 145*c*, so that the electric power supply can be spent to the motor 109. A stroke of the first output power shaft 133 required for pushing the knob 108 downward in the above operation is corresponding to the reason that the deep ditch portion 132 has the depth larger than that required for the engagement with the knock pin 134.

Next, description is made about the constitution of the cap opening apparatus 400 including the second intermediate gear 126 as an example of the second transfer section.

The bevel gear 135 having a bevel of 45 degrees as outer tooth of the second intermediate gear 126 is constituted to be engaged with a bevel gear 136 having a bevel of 45 degrees, as illustrated in FIG. 4. The bevel gear 136 is fixed to one end of a horizontal rotation axis 138 so that the bevel gear 136 may be capable of rotating integrally with the horizontal rotation axis 138, as illustrated in FIG. 3. With this structure, the horizontal rotation axis 138 is adjusted to rotate by a rotation of a vertical rotation axis 124.

In addition, a small gear 137 is fixed to another end of the horizontal rotation axis 138. The small gear 137 is adjusted to be engaged with a small gear 137' of a specification completely similar to that of the small gear 137 in order to reverse a direction of rotation. The small gear 137' is adjusted to be engaged with the last stage gear 139. The last stage gear 139 is fixed to one end of a second output power shaft (second last end output power shaft) 140. The can sending gear 112 is fixed to another end of the second output power shaft 140. With this structure, it is possible to realize, what we call, can opener function for cutting and opening a can wall of a method that the can is enclosed by being wound up, as mentioned before.

In the description for the above embodiment, concrete numerals of numbers of teeth of each gear are omitted. However, this embodiment basically aims at increasing rotation torque by decreasing numbers of rotations. In this embodiment, numbers of rotations of the first output power shaft 133 are adjusted to be fewer than those of the second output power shaft 140. Of course, rotation torque of the first output power shaft 133 is adjusted to be larger than that of the second output power shaft 140. Namely, in the cap opening apparatus 400, a first slowdown ratio of a constitution transferring power to the first output power shaft 133 is adjusted to be larger than a second slowdown ratio of a constitution transferring power to the second output power shaft 140. In this embodiment, a ratio of the rotation torque between the first output power shaft 133 and the second output power shaft 140 is adjusted to be 5:1. By plenty of experiments, inventors of the present invention have recognized that favorable ratio of the rotation torque is substantially between 2:1 and 10:1. Besides, ratio of the rotation torque other than the above ratio can be used alternatively.

Next, description is made about a constitution and operations of an output power changing section for selectively driving the first intermediate gear 125 and the second intermediate gear 126.

FIG. 4 is a perspective view of the cap opening apparatus according to the first embodiment of the present invention, in which a part of the output power changing section is included.

The speed changing gear 123 is adjusted to be engaged with the first intermediate gear 125 unless the change lever 115 is being pushed downward by the repulsion of the return spring 116. The change lever 115 which is a component of the speed changing portion 50 is integrally formed by resin. The head portion 115*a* of the change lever 115 is constituted to be projected from a front of the upper case 100 to a position receiving the can opener lever 113, as illustrated in FIG. 1. A guide pin 141 is inserted through a sliding portion 115*b* of the change lever 115, so that the sliding portion 115*b* is freely capable of sliding up and down in line with the guide pin 141. The sliding portion 115*b* is always pushed upward by the return spring 116. A fork portion upper jaw 115*c* and a fork portion lower jaw 115*c*' of the change lever 115 are sandwiching the large gear of the speed changing gear 123 there between up and down. The speed changing gear 123 is capable of sliding up and down in line with the rotation axis 124. However, the speed changing gear 123 is usually offset upward by the repulsion of the return spring 116. In other words, the speed changing gear 123 is offset upward by the repulsion of the return spring 116, unless the change lever 115 is being pushed downward in this embodiment. Namely, the speed changing gear 123 is adjusted to be engaged with the first intermediate gear 125 unless the change lever 115 is being pushed downward. Besides, in a case that the head portion 115*a* of the change lever 115 is pushed downward against the repulsion of the return spring 116, the speed changing gear 123 comes to be engaged with the second intermediate gear 126. The SW operation portion 115*d* of the change lever 115 then becomes operable to push the knob 108 of the SW 107 down so that the electric power supply may be spent.

In a case that a cap of a can or a jaw of screw lid method is rolled and opened, the user mounts the screw lid container 4 on the rotation stand 203 and pushes the upper housing 1 down by handling the handle 103, as mentioned before. Subsequently, the change lever 115 is pushed upward by the return spring 116. Accordingly, the speed changing gear 123 is engaged with the first intermediate gear 125. In other words, the output power shaft 133 is in an effective condition (condition capable of transferring power). Under the condition, the upper handling portion 102 starts rotating, when the SW 107 is pushed on. In this case, the output power shaft 140 which becomes effective by the engagement of the speed changing gear 123 with the second intermediate gear 126 is in a separate condition (namely, condition incapable of transferring power). Consequently, the can sending gear 112 is never driven.

On the other hand, in a case that a can is opened by the use of the can opener function, the user pushes the can opener lever 113 down. Consequently, the user can keep the can food 5 in a condition that the can food 5 is squeezed by the screwing and enclosing end peripheral portion 53 and the metal cutting blade 114. Thereafter, the user further pushes the can opener lever 113 downward. In this case, the head portion 115*a* of the change lever 115 is pushed downward from the condition shown in FIG. 4. Against the repulsion of the return spring 116, the change lever 115 integrally formed is, as a whole, pushed downward in line with the guide pin 141. The speed changing gear 123 is pushed from upward to downward by the fork portion upper jaw 115*c*. The largely chamfered small gear 123*b* of the speed changing gear 123 is thereby slid to a position in which the largely chamfered small gear 123*b* comes to be engaged with the inner tooth of the second intermediate gear 126. In addition, the SW operation portion 115*d* pushes the knob 108 of the SW 107 down at the same time, so that the electric power supply is spent. The motor 109 is started, so that the can sending gear 112 fixed to the output power shaft 140 thereby comes to be rotated. Accordingly, the upper handling portion 102 fixed to the output power shaft 133 is never driven, in the case that the can is opened by the use of the can opener function.

Next, description is made about a constitution and operations of the lower handling portion 204.

Figure 6:
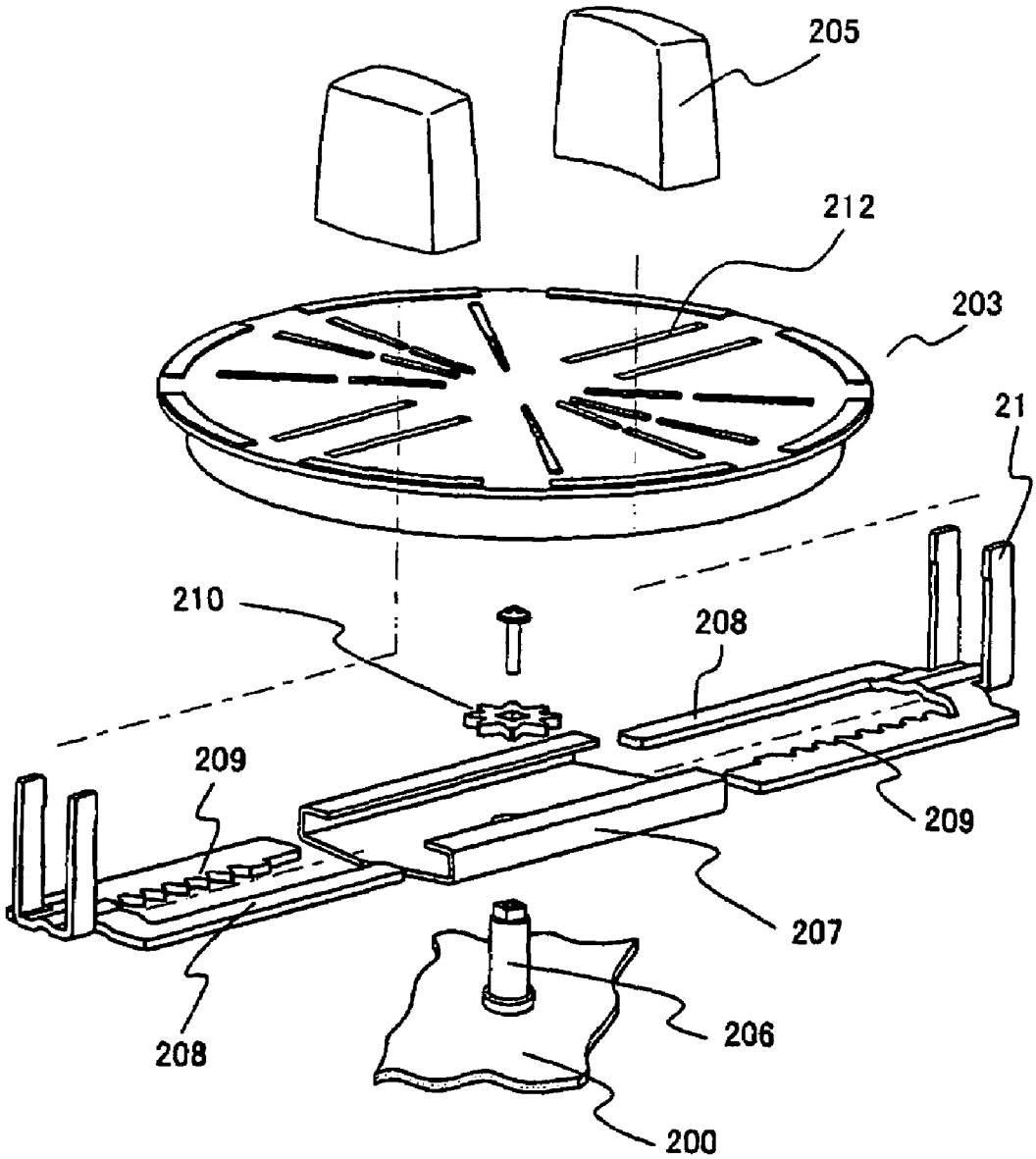
FIG. 6 is an exploded perspective view of a lower handling portion of the cap opening apparatus according to the first embodiment of the present invention.

FIG. 6 is an exploded perspective view of the lower handling portion 204 of the cap opening apparatus 400 according to the first embodiment of the present invention.

A fixed pin 206 is vertically projected and provided in a center of the lower case 200. The fixed pin 206 has a circular hole dug in substantially central portion thereof. A slider holder 207, which has a bended portion formed by a pair of bended sides facing to each other, is connected to the fixed pin 206 so that the slider holder 207 may be capable of rotating around the fixed pin 206. A pinion gear 210 and a pair of sliders 208 each having a rack portion 209 formed to be engaged with the pinion gear 210 are contained inside the slider holder 207. The pinion gear 210 is fixed by screw with the pinion gear 210 being engaged with a square portion of a head of the fixed pin 206.

In the lower handling portion 204, the slider holder 207 is rendered to be rotating around the fixed pin 206 in a counter-clockwise direction seen from the upward thereof (corresponding to that the pinion gear 210 is rendered to be rotating in a clockwise direction). At this time, while a pair of the rack portions 209 are rotating around the pinion gear 210, the rack portions 209 are sent by the engagement with the pinion gear 210 and operable to be sliding horizontally toward a center of rotations.

Two main bone portions 211 are projected and provided vertically with respect to planes of the sliders 208, respectively in end portions of a pair of the sliders 208 opposite to the fixed pin 206. The rotation stand 203 of which a surface is covered by a material hard to glide, such as rubber material, and the like is mounted on an upper surface of the bended portion of the slider holder 207. The main bone portions 211 are inserted through long holes portions 212 formed on the rotation stand 203 so as to be elongated up to the upper side of the rotation stand 203. Squeezing nails 205 of which surfaces are covered by materials hard to glide, such as rubber materials, and the like are inserted into end surfaces of the main bone portions 211 from the upper sides thereof, so that the squeezing nails 205 are adjusted to squeeze and fix the rotation stand 203, as illustrated in FIG. 1.

In the lower handling portion 204 having the constitution thus mentioned, let the screw lid container 4 be mounted on the rotation stand 203. Further, let the outer circumferential portion of the rotation stand 203 be rotated in a counter-clockwise direction by the user's hand. Consequently, the main bone portions 211 of the sliders 208 are rendered to be rotating in counter-clockwise directions seen from the upwards thereof by the side surfaces of the long holes portions 212. As a result, a pair of the sliders 208 slides horizontally toward a center of each other, as mentioned above. Therefore, while a pair of the squeezing nails 205 push the container portion 42 of the screw lid container 4 from both sides of the container portion 42 each other, a pair of the squeezing nails 205 inserted and fixed into the main bone portions 211 draw the container portion 42 accurately toward the center axis of the rotation stand 203 corresponding with the rotation axis of the rotation torque applied at the time of opening the cap.

Next, description is made about a constitution and operations of the upper handling portion 102.

Figure 7:
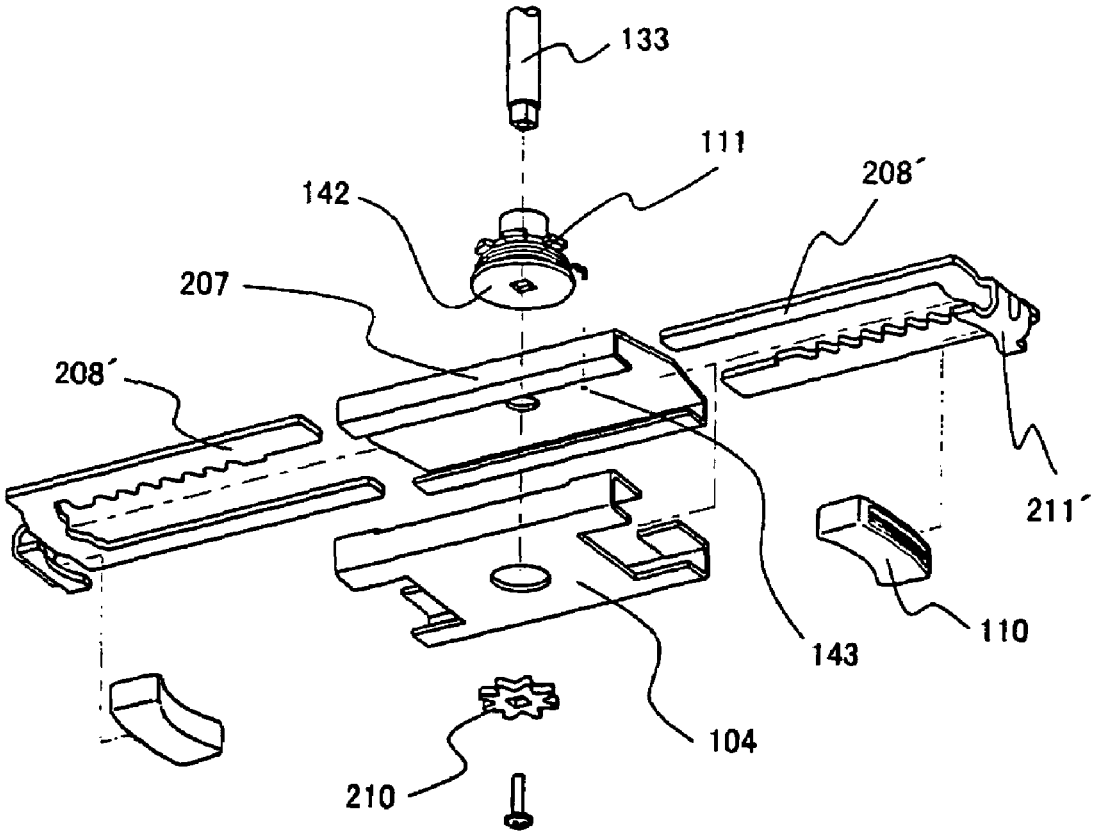
FIG. 7 is an exploded perspective view of an upper handling portion of the cap opening apparatus according to the first embodiment of the present invention.

FIG. 7 is an exploded perspective view of the upper handling portion 102 of the cap opening apparatus according to the first embodiment of the present invention.

Since the upper handling portion 102 and the lower handling portion 204 have principles for squeezing objects completely identical with each other, the upper handling portion 102 can use many components similar to those of the lower handling portion 204.

In this embodiment, the upper handling portion 102 uses components similar to the slider holder 207 and the pinion gear 210 of the lower handling portion 204. Further, the sliders 208 of the upper handling portion 102 are almost identical with those of the lower handling portion 204, except for shapes of the main bone portions 211 a part of which is different from that of the lower handling portion 204. Namely, two main bone portions 211 are projected and provided vertically with respect to planes of the sliders 208, respectively in the lower handling portion 204. On the contrary, main bone portions 211' of the upper handling portion 102 are adjusted that end surfaces are bended by 180 angles to face the insides for the purpose of squeezing the cap 41 of the screw lid container 4, and that the squeezing nails 110 covered by a material hard to glide, such as rubber material, and the like are inserted into the end surfaces. It is favorable for the squeezing nails 110 to squeeze the cap 41 having a small thickness of the screw lid container 4 equally from both sides thereof.

The upper handling portion 102 is connected to the output power shaft 133 which is projected and chinned from a center of a lower surface of the upper case 100. A square portion is formed in a head of the output power shaft 133. A screw hole is formed in the square portion in an axis direction of the output power shaft 133.

A return spring 111 formed by a Tsurumaki spring of clockwise twining is wound around a bobbin 142 in a condition that an upper end of the return spring 111 is fixed on the bobbin 142. The bobbin 142 is fitted to the output power shaft 133 with a square hole formed in the bobbin 142 being engaged with the square portion of the output power shaft 133. A pinion gear 210, and a pair of sliders 208' each having a rack portion 209 formed to be engaged with the pinion gear 210 are contained inside the slider holder 207. A friction pad 104 is put on the slider holder 207. Under the bobbin 142 and the slider holder 207, the pinion gear 211 is fitted to the output power shaft 133 with a square hole formed in the pinion gear 211 being engaged with the square portion of the output power shaft 133. A head of the pinion gear 211 is then fixed to the output power shaft 133 by screw. The slider holder 207 is thereby supported by the pinion gear 211 from the lower side and is kept capable of revolving by the pinion gear 211.

Further, a lower end of the return spring 111 is fixed in a small hole 143 of the slider holder 207. In this case, after a turn is added to the return spring 111, the lower end of the return spring 111 is fixed in the small hole 143. The turn is added to the return spring 111 to a certain extent that the return spring 111 keeps a little return power, namely, a little power for further separating the squeezing nails 110, even if the squeezing nails 110 are in the remotest position.

The upper handling portion 102 is constituted thus mentioned above. Accordingly, if the SW button 105 is pushed on or the friction pad 104 is pushed in contact with the screw cap 41 in a condition that the screw lid container 4 is strongly handled by the lower handling portion 204 to keep the rotation stand 203 being locked (further the speed changing portion 50 is spent to a side of the output power shaft 133), the motor 109 starts rotating. The output power shaft 133 is to rotate in a clockwise direction seen from the downside thereof. In this case, since the friction pad 104 exposed on the lowest surface of the upper handling portion 102 is frictionally engaged with the screw cap 41 in the locked condition, the rotation of the upper handling portion 102 is restricted.

The rotation of the upper handling portion 102 is thus restricted. However, since the bobbin 142 around which the return spring 111 is wound and the pinion gear 210 are fixed to the output power shaft 133 by screw, the pinion gear 210 driven by the output power shaft 133 rotates in a clockwise direction seen from the downside thereof. As a result, a pair of the sliders 208' in which the pinion gear 210 is engaged with the rack portions 209 slides horizontally toward a center of each other. Therefore, a pair of the squeezing nails 110 become close to the screw cap 41 from both sides of the container portion 42 each other and squeeze the screw cap 41 from both sides thereof. The squeezing nails 110 then draw the screw cap 41 accurately up to the rotation axis, while the squeezing nails 110 rotate in a clockwise direction. Consequently, the screw cap 41 comes to be in a condition that the screw cap 41 cannot be drawn more (locked condition). During the time for becoming the locked condition, the rotation of the slider holder 207 of the upper handling portion 102 is restricted. On the contrary, the bobbin 142 rotates continuously. Consequently, the return spring 111 of clockwise twining is continuously pushed to save the repulsion.

In the operations mentioned above, if the motor 109 rotates even after the squeezing nails 110 become close to and squeeze the screw cap 41 from both sides thereof to be in a condition incapable of being drawn more (locked condition), the lower handling portion 204 forces the container portion 42 in a counter-clockwise direction by a law of action/reaction. Thereby, in correspondence with the rotation power of the upper handling portion 102 which is to rotate continuously with the screw cap 41 being kept squeezed, the screw cap 41 and the container portion 42 are turned by the power opposite to each other to open the screw cap 41 soon.

The screw cap 41 being opened, the electric power supply is stopped by releasing the SW button 105 or the handle 103. Thereby, the rotations of the motor 109 are stopped. Thereafter, the repulsion stored by the return spring 111 make the upper holding portion 102 rotate reversely in the direction that pair of squeezing nails 110 are separated from each other. Consequently, a power for squeezing the screw cap 41 is released. It therefore becomes possible to readily remove the screw cap 41.

The cap opening apparatus 400 further has a cap bottle opener function. As illustrated in FIG. 1, metal fittings of cap bottle opener 146, of which a head portion is bended to have a hook shape for hanging a capsule (crown cap) of a bottle, or the like, is fixed in a front of a body of the cap opening apparatus 400. The crown cap of the bottle, or the like can be opened by the metal fittings of cap bottle opener 146.

According to this embodiment, a plurality of output power shafts responsive to the purposes is provided with respect to one motor. By way of a speed changing section consisting mainly of power transferring and output power changing mechanism for reducing and transferring number of rotations of the motor, optimized number and torque of rotations for respective output power shafts can be selectively transferred. Further, since it is enough to prepare a single power source, such as a motor, and the like, manufacturing cost of the cap opening apparatus can be reduced. Moreover, by selectively transferring power to an output power shaft corresponding with the predetermined purpose by the use of an output power changing section, it becomes possible to completely prevent an output power shaft having the other function of non-use being operable during the use of one function. Thereby, safety of the cap opening apparatus can be improved.

Embodiment 2

The second embodiment has some points largely different from those of the first embodiment. Namely, an upper housing 1' is such one of hanging type fixed on a lower surface of a cupboard, or the like, so that an operation handle 360 for making a lower housing 2' be up and down is provided in the second embodiment.

Besides, almost constitutions and functions of the second embodiment are not varied substantially from those of the first embodiment. Accordingly, description will be made only about the different points. Similar components, structures, points, and the like are shown by similar reference numerals while detailed description about them is omitted.

Figure 8:
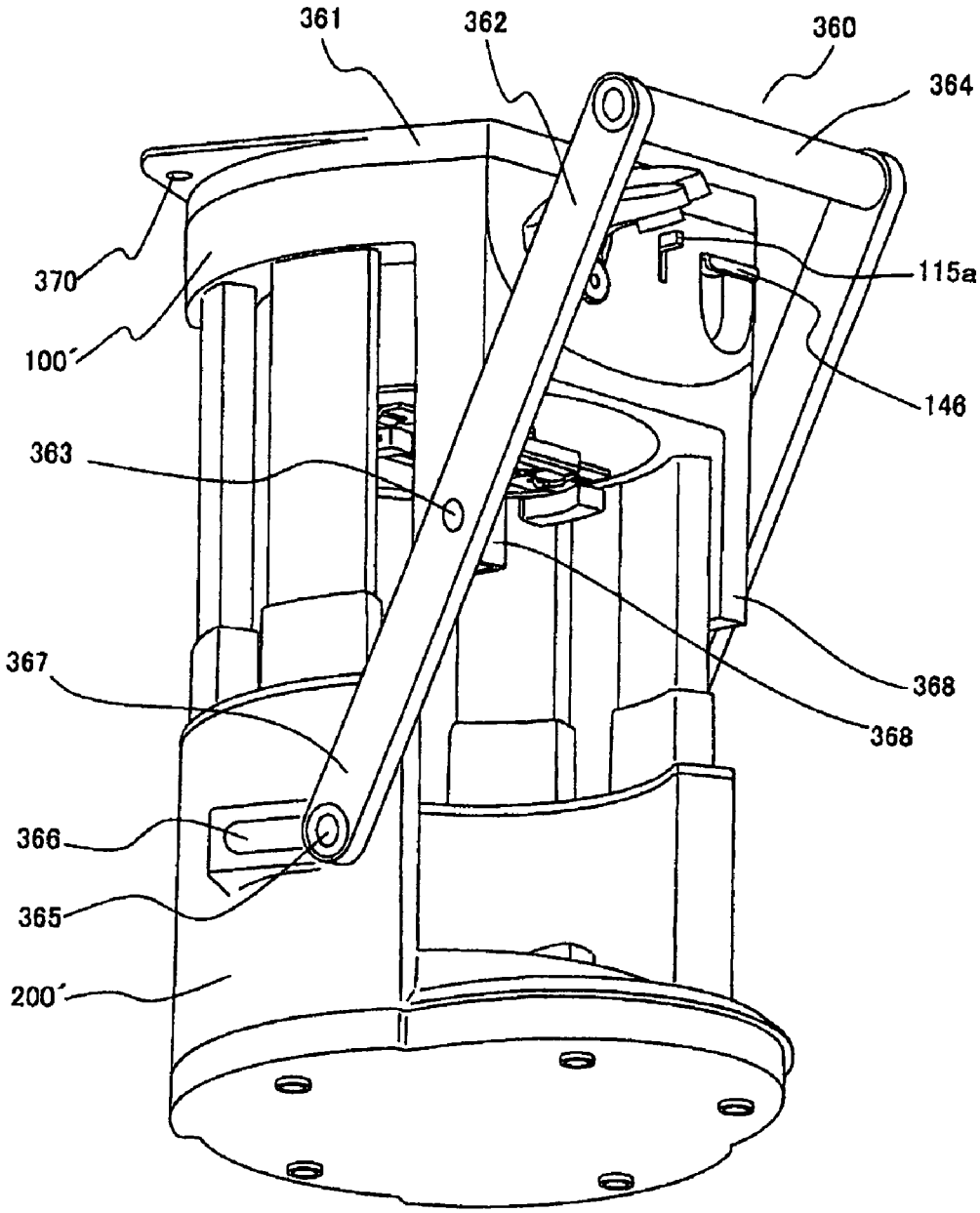
FIG. 8 is a perspective view of an external appearance of a cap opening apparatus according to a second embodiment of the present invention.

Referring to FIG. 8 and the other figures, description is made about the second embodiment of the present invention.

FIG. 8 is a perspective view of an external appearance of a cap opening apparatus according to the second embodiment of the present invention.

In the cap opening apparatus 300 according to the second embodiment, the upper housing 1' which constitutes a partial aggregate is varied from the upper housing 1 of the first embodiment in the following points. Namely, components of the first embodiment for constituting a ceiling portion of the upper case 100, such as the handle 103, the SW button 105, and the like are deleted. Alternatively, a top board 361 having a screw hole 370 for fixing and a hanging portion of hook type (not shown) on its upper surface of front side is fixed on the most upper portion of the upper case 100'. According to this cap opening apparatus 300, after the hanging portion of hook type is hanged over metal fittings fixed on a lower surface of a hanging closet, and the like, the cap opening apparatus 300 can be fixed on the lower surface of the hanging closet, and the like by fixing the screw hole 370 of a back side with a wooden screw.

A gear box 120 which contains a motor 109, a speed changing portion 50, and the like in inside thereof is fixed to the upper case 100'. A can sending gear 112, a can opener lever 113, a head portion 115*a* of a change lever 115, metal fittings of corkscrew 146, and the like are located and contained in the front of the body, similarly to those of the first embodiment. In both sides of lower portions of both side surfaces of the upper case 100', there is provided a bearing portion 368 as an example of a supporting portion for supporting a pin 363 provided substantially near a center of an arm portion 362 as an example of a bar member of an operation handle 360 with the pin 363 being freely capable of rotating. Thereby, when the user revolves the operation handle 360 from upward to downward by squeezing a grasp portion 364, a head portion 367 of the operation handle 360 revolves from downward to upward with the bearing portion 368 being the fulcrum.

In the head portion 367 of the arm portion 362 of the operation handle 360, a pair of projecting portions 365 are projected and provided with the projecting portions 365 facing the inside. The projecting portions 365 are engaged with guide grooves 366 as examples of keeping portions formed on both side surfaces of the lower case 200', so that the projecting portions 365 are capable of sliding smoothly in line with the guide grooves 366. In addition, the projecting portions 365 are capable of revolving within the guide grooves 366. The projecting portions 365 may be made of a material of resin having good lubrication characteristics. On the contrary, the projecting portions 365 may have a pulley. Herein, in this embodiment, a revolving plane of the arm portion 362 around the pin 363 and another revolving plane of the arm portion 362 within the guide groove 366 are substantially identical planes with each other. Further, the guide groove 366 is constituted so that the projecting portions 365 are capable of sliding in a horizontal direction upon the another revolving plane.

The lower housing 2' has a constitution and a function completely similar to those of the lower housing 2 of the first embodiment, except that the guide groove 366 is provided to be engaged with the projecting portions 365 of the operation handle 360. Namely, the lower case 200' has, in a center thereof, a lower handling portion 204 in which a rotation stand 203 for mounting the screw lid container 4 is mounted. A supporting pole 101 hanged from an outer circumference of a lower surface of the upper case 100' is inserted through a guide hole 201 dug on the upper surface of the lower housing 2' with a minute gap being kept between the supporting pole 101 and the guide hole 201. The lower housing 2' is thereby constituted to be freely capable of sliding upward and downward.

Accordingly, if the user revolves the operation handle 360 downward by squeezing the grasp portion 864 from a condition that the operation handle 360 is risen up to the highest position, the head portion 367 of the arm portion 362 revolves upward with the pin 363 being the fulcrum of revolving. As such the operations proceed, the projecting portions 365, while moving upward, are to slide in line with the guide groove 366 toward the deepest portion (a direction of left-hand of FIG. 8). Then, the projecting portions 365 reach the deepest portion of the guide groove 366, when the arm portion 362 has become horizontal. If the user continuously revolves the operation handle 360 downward, in turn, the projecting portions 365, while moving upward, are to slide in line with the guide groove 366 toward the front portion.

By such operations in series, when the projecting portions 365 move upward, the lower case 200' integrally formed with the guide groove 366 also moves upward. As a result, the lower housing 2' is lifted upward. On the other hand, if the user revolves the operation handle 360 upward by squeezing the grasp portion 364, the lower housing 2' is brought downward. Thus, according to the cap opening apparatus 300 of this embodiment, it is possible to make the upper housing 1' and the lower housing 2' slide in upward and downward directions.

The cap opening apparatus 300 is strongly fixed on the lower surface of the hanging closet, and the like, by the wooden screw. The cap opening apparatus 300 is usually put in a condition that the grasp portion 364 is lifted, namely, the lower housing 2' is brought downward. In the cap opening apparatus 300, the user mounts the screw lid container 4 on the rotation stand 203 and rotates the outer peripheral portion of the rotation stand 203 by his hand in a counter-clockwise direction. Consequently, the squeezing nails 205 squeezes the screw lid container 4 strongly. Thereafter, as the user is bringing the grasp portion 364 down, the lower housing 2' is raised gradually. Accordingly, the screw cap 41 is rendered to be pushed into contact with the friction pad 104 of the upper holding portion 102. As a result, since the friction pad 104 is rendered to be pushed into contact with the screw cap 41, the SW 107 is pushed on and the motor 109 thereby starts rotating, similarly to the first embodiment. Thereby, the squeezing nails 110 of the upper holding portion 102 squeeze and tighten the screw cap 41 firmly from both sides thereof. Thereafter, the upper holding portion 102 turns the screw cap 41 to open the screw cap 41, similarly to the first embodiment.

According to the cap opening apparatus 300 of the second embodiment, the upper housing 1' can be fixed on the lower surface of the hanging closet, and the like, while the lower housing 2' can be brought up and down by the operation handle 360. Consequently, not only a space for locating and containing the cap opening apparatus 300 can be reduced but also operation characteristics can be improved.

Description of the Numerals

1 upper housing,
2 lower housing,
100 upper case, 102 upper holding portion, 104 friction pad,
105 SW button,
108 knob,
110 squeezing nail,
111 return spring,
112 can sending gear,
113 can opener lever,
115*c* fork portion upper jaw,
115*c*' fork portion lower jaw,
116 return spring,
122 slowdown gear,
123 speed changing gear,
124 rotation axis,
129 the last stage gear,
133 output power shaft,
140 output power shaft,
145 close bar,
200 lower case,
203 rotation stand,
204 lower handling portion,
205 squeezing nail,
207 slider holder,
208 slider,
210 pinion gear,
300 cap opening apparatus,
360 operation handle,
364 grasp portion,
365 projecting portion,
366 guide groove,
400 cap opening apparatus.

The invention claimed is:

1. A cap opening apparatus comprising:

a single power source for generating power;

a first last end output power shaft which is capable of rotating by receiving a transfer of the power;

a second last end output power shaft which is capable of rotating by receiving a transfer of the power;

a first transfer section for transferring the power generated by the single power source to the first last end output power shaft;

a second transfer section for transferring, independently from the first transfer section, the power generated by the single power source to the second last end output power shaft at a gear ratio different from that of the first transfer section;

a first cap opening section which squeezes a cap of a first article to be opened and opens the cap by rotating the cap by a use of rotation driven by the first last end output power shaft, the first article to be opened being closed by a cap which is fitted to the first article with a screw path; and a second cap opening section which cuts a wall of a second article to be opened and opens the cap by the use of rotation driven by the second last end output power shaft.

2. The cap opening apparatus as claimed in claim 1, wherein the first transfer section has a gear ratio larger than that of the second transfer section.

3. The cap opening apparatus as claimed in claim 1, wherein the first opening section further comprises a cap handling portion for narrowing a gap between squeezing nails for squeezing the cap of the first article to be opened by the rotation in one direction of the first last end output power shaft, and a spring which stores a repulsion for rotation in the other direction at a time of the rotation in one direction; the first last end output power shaft being rotated in the other direction by the repulsion of the spring to release handling of the cap of the first article to be opened by the cap handling portion, when a transfer of power from the single power source to the first last end output power shaft has been finished.

4. The cap opening apparatus as claimed in claim 1, wherein the first opening section further comprises:

a lower handling portion which handles a lower portion of the first article to be opened;

a lower housing in which the lower handling portion is provided; and an upper housing in which a cap handling portion is provided, wherein a supporting pole is provided in one of the upper housing or the lower housing and a guide member is provided in the other of the upper housing or the lower housing, and a guide hole for guiding the supporting pole is formed in the guide member, the supporting pole being inserted through the guide hole and thereby the upper housing and the lower housing are capable of sliding up and down to each other.

5. The cap opening apparatus as claimed in claim 1, further comprising:

a friction pad;

a supporting portion which supports the friction pad in the upper housing with the friction pad capable of rotating on a predetermined plane surface; and a handling portion which handles the friction pad in the lower housing, wherein the friction pad is capable of rotating on a plane surface and moving in a horizontal direction on the plane surface.

* * * * *